US006973749B2

(12) United States Patent
Levilly

(10) Patent No.: US 6,973,749 B2
(45) Date of Patent: Dec. 13, 2005

(54) EQUIPMENT FOR TESTING A SMALL-CALIBRE WEAPON ON A TEST BENCH

(75) Inventor: Philippe André Jean Levilly, Cormolain (FR)

(73) Assignee: Sogesta, Bayeux Cedex (FR)

( * ) Notice: Subject to any disclaimer, the term of this patent is extended or adjusted under 35 U.S.C. 154(b) by 14 days.

(21) Appl. No.: 10/706,342

(22) Filed: Nov. 12, 2003

(65) Prior Publication Data

US 2004/0139645 A1 Jul. 22, 2004

(30) Foreign Application Priority Data

Nov. 13, 2002 (FR) ..... 02 14169

(51) Int. Cl.[7] ..... F41A 29/00
(52) U.S. Cl. ..... 42/94; 89/37.02
(58) Field of Search ..... 42/94; 89/37.01, 89/37.04, 37.07

(56) References Cited

U.S. PATENT DOCUMENTS 2,458,608 A * 1/1949 Lea ..... 89/37.04
2,991,579 A * 7/1961 Lies ..... 42/94
4,621,563 A 11/1986 Poiencot
4,819,359 A * 4/1989 Bassett ..... 42/94
5,056,410 A * 10/1991 Pitts ..... 89/37.04
5,375,804 A * 12/1994 Levilly ..... 89/37.04
5,703,317 A * 12/1997 Levilly et al. ..... 89/37.03
2004/0148840 A1 * 8/2004 Levilly ..... 42/94

FOREIGN PATENT DOCUMENTS

DE 195 32 154 A1 3/1997

* cited by examiner

*Primary Examiner*—Michael J. Carone
*Assistant Examiner*—Troy Chambers
(74) *Attorney, Agent, or Firm*—Baker & Daniels

(57) ABSTRACT

Equipment for installing a small-calibre weapon on a test bench, comprising U-shaped stirrups provided with clamping screws for bearing against the weapon and locking it in the stirrups.

Figure 1B:
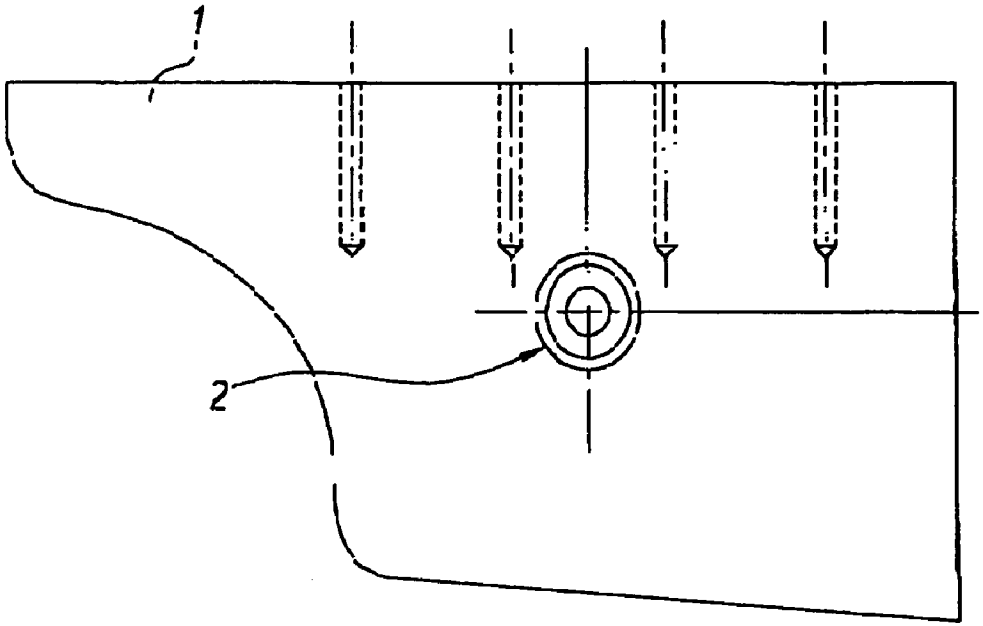

It comprises a set of cavities (21-1, 22-2) which have a spherical base and which are formed in the weapon at the bearing points of the clamping screws (4), and clamping screws (4) which have a spherical head (42) and which are carried by the stirrups (6) and housed in the spherical-based cavities (21-1, 22-1) of the weapon to be tested.

6 Claims, 4 Drawing Sheets

EQUIPMENT FOR TESTING A SMALL-CALIBRE WEAPON ON A TEST BENCH

FIELD OF THE INVENTION

The present invention relates to equipment for installing a small-calibre weapon on a test bench, comprising U-shaped stirrups provided with clamping screws for bearing against the weapon and locking it in the stirrups.

There is a test bench according to document FR 92 05 643 in which weapons to be tested, such as guns, are secured in two stirrups which have a U-shaped cross-section and which receive the weapon. These two stirrups are adjusted in terms of spacing and height as a function of the weapon to be tested and the weapon is secured by means of clamping screws carried by the walls of the U-shaped stirrups. These clamping screws are terminated by a block which is to fit the shape of the weapon at the points of contact with the clamping screw.

OBJECT OF THE INVENTION

The object of the present invention is to develop equipment for a test bench of the type defined above in such a manner as to accelerate and simplify the positioning of the weapon in order to increase the efficiency and reproducibility of the tests carried out on the same weapon or weapons of the same type.

To that end, the invention relates to equipment of the type defined above, characterised in that it comprises:

a set of cavities which have a spherical base and which are formed in the weapon at the bearing points of the clamping screws, and clamping screws which have a spherical head and which are carried by the stirrups and housed in the spherical-based cavities of the weapon to be tested.

The weapon so prepared can be positioned in a precise manner in the stirrups and thus relative to the test bench.

The form-fit between each cavity having a spherical base and the spherical head of the clamping screw cooperating with that cavity enables the weapon to be locked and held in an excellent manner during test firing. The shallow cavities having a spherical base do not constitute relief portions impeding the gripping of the weapon.

The installation of a weapon in the test bench is extremely rapid if the weapon is a mass-produced weapon for which the previous adjustment of the test bench, that is to say, the spacing and the positioning of the U-shaped stirrups, is identical, the location of the spherical-based cavities formed in weapons of the same series being in principle identical. This positioning of the weapon in the test bench avoids the need for any other securing (flanging) of the weapon, for example by a top-mounted securing module which would have to be fitted on the top of the weapon.

The spherical-based cavities and the clamping screws, or at least the spherical heads cooperating with the spherical cavities, are produced from treated steel or from titanium, in order not to exhibit wear even after a relatively large number of test shots, because there should not be any erosion or deformation there caused by bruising.

According to one advantageous feature, the cavity having a spherical base is formed in an insert incorporated in the weapon. This insert is advantageously constituted by two associated cylindrical sleeves forming two cavities having a spherical base which are opposite one another and are preferably symmetrical relative to the longitudinal plane of symmetry of the weapon and these two sleeves are assembled in a drilled hole extending through the weapon. The drilled hole is formed in a portion of the weapon that is capable of being drilled, such as the butt or the hand-rest.

The two sleeves may be provided with complementary threads, one constituting a male threaded member and the other a female threaded member, in order to be screwed together in a manner which is locked, optionally by adhesive bonding.

For that purpose, it is advantageous if the outer edge of each sleeve comprises a slot permitting the positioning of a screwing tool.

According to another embodiment, the two sleeves are provided one with a cylindrical housing and the other with a cylindrical spindle which is to engage in the cylindrical housing when the two sleeves are assembled in an orifice formed in the weapon, these two sleeves being assembled by adhesive bonding.

According to the invention, the two cylindrical sleeves have a stepped diameter in order to form a shoulder on each side of the assembly formed by the two sleeves so as to enable the weapon to be clamped and to prevent the two sleeves from coming out of the drilled hole. The drilled hole is of course also in stepped form with two spot faces on each side for receiving the portion of large diameter.

According to another feature, the cavity having a spherical base is machined in the weapon during the manufacture thereof or after manufacture.

Such a cavity may be formed in any portion of the weapon that is made of hard steel, with the exception of the barrel.

Generally, the equipment according to the invention enables the speed of installation or mounting/dismounting of the weapon on the test bench to be increased because the weapon is very easy to flange. This equipment ensures the reproduction of the flanging coordinates of the weapon and avoids the use of accessories, in particular a heel plate stop.

Another major advantage of the inserts in association with the test bench is that the operator carrying out the tests does not have to re-aim the test bench at the target after changing one weapon for another of the same model since the latter's reference position in space is identical.

The present invention increases operator safety on ballistic test benches because even if the clamping screws are not correctly tightened the weapon is sufficiently trapped by the stirrups not to change direction suddenly and thus guarantees the approximate landing place of the projectile.

The hole for approaching the inserts may be slightly conical in order to permit robotised gripping, which allows a greater tolerance in terms of the coordinates for approaching the clamping axes, especially pneumatic ones.

In general, the outer shape of an insert is more or less unrestricted owing to the fact that the dimensional characteristics and the shape configurations of weapons are never the same from one make to another.

Only the diameter, the depth and the shape of the base of the hole of the insert have to be compatible with the dimensional and shape characteristics of the ends of the clamping screws of the test benches. The shock waves and the residual vibrations are in fact transmitted by this equipment towards the test bench proper. Finally, it is very advantageous for locking if the cavities having a spherical base are disposed symmetrically on the lateral surfaces of the weapons at the front and the rear.

In general, the invention is applicable to all long weapons or hip weapons permitting the incorporation of spherical-based cavities, either produced directly in the mass or by way of inserts.

DRAWINGS

Figure 1A:
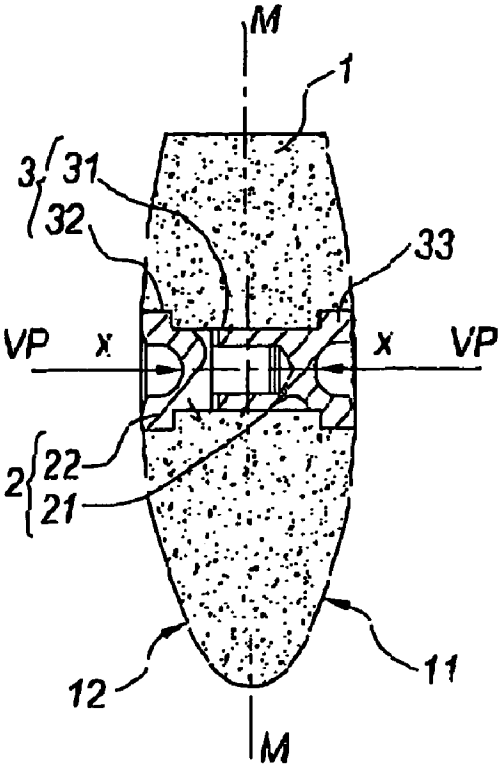
Figure 2A:
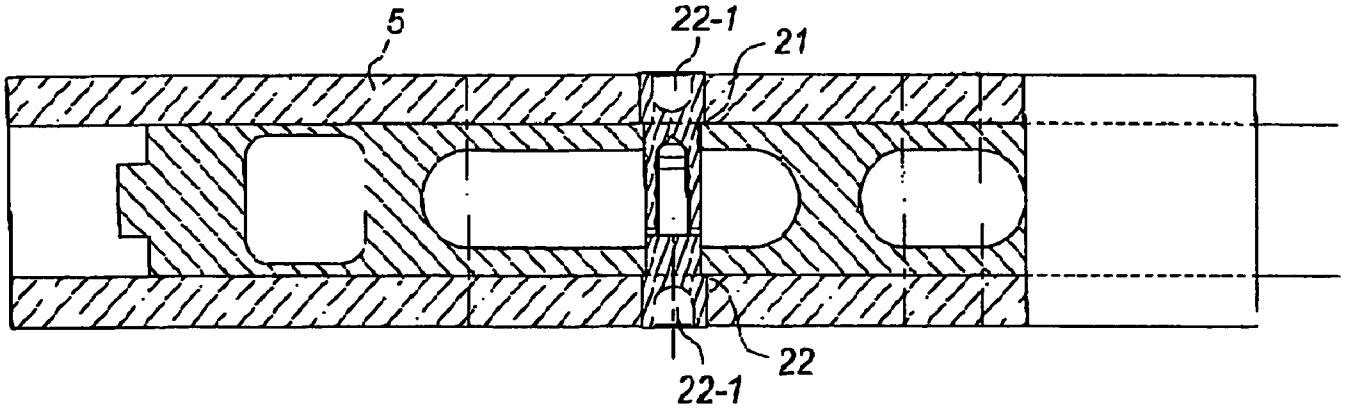
Figure 2B:
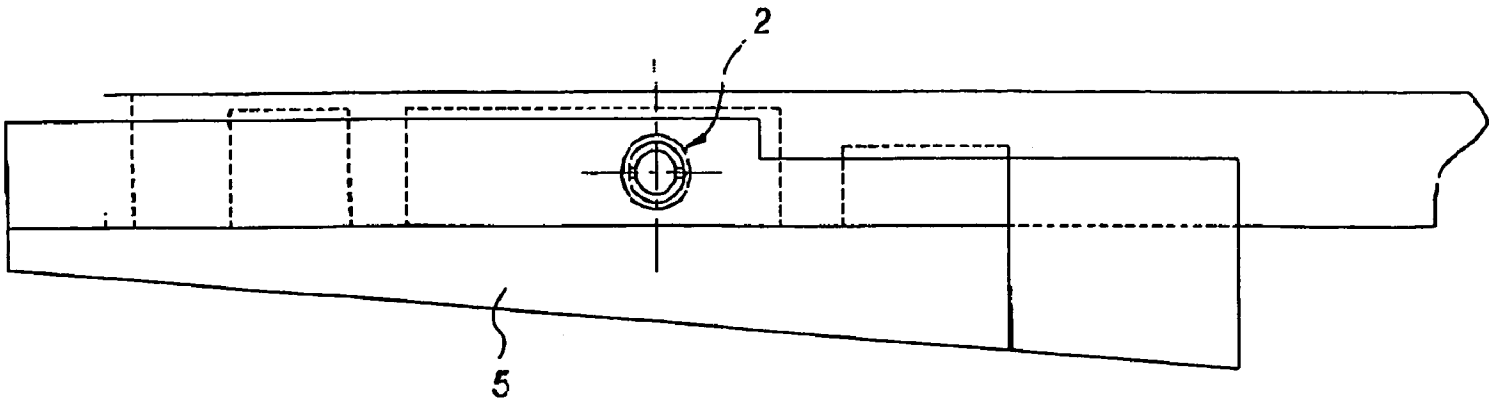
Figure 3B:
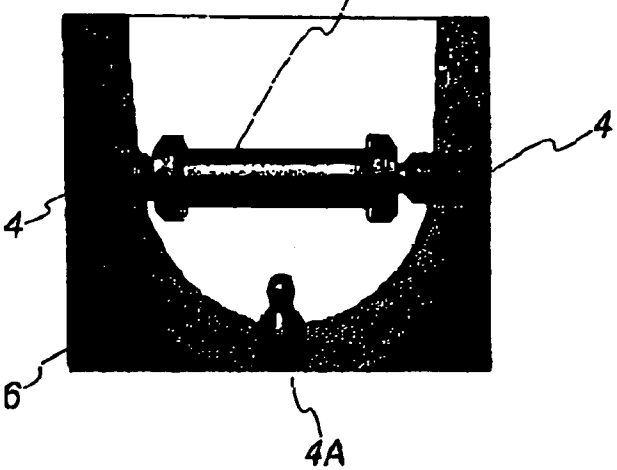
Figure 3A:
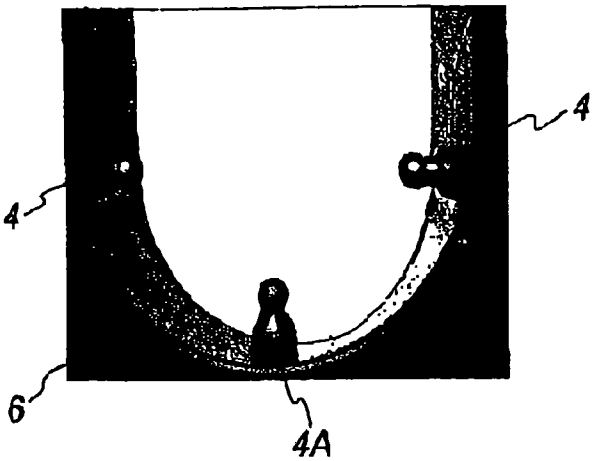
Figure 7:
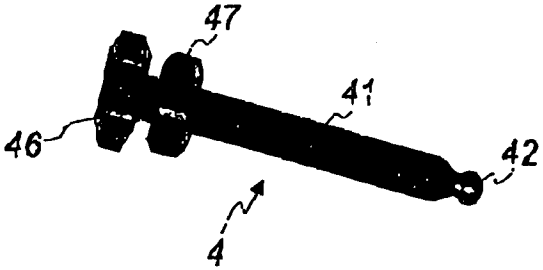
Figure 6:
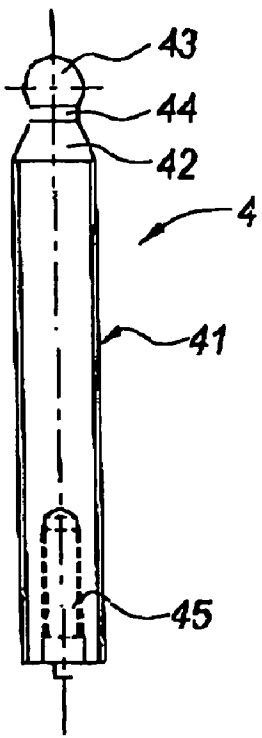
Figure 5A:
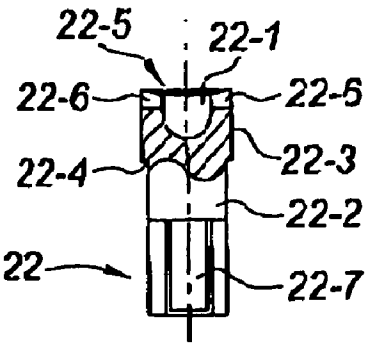
Figure 5B:
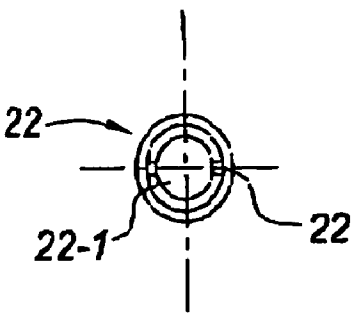
Figure 4B:
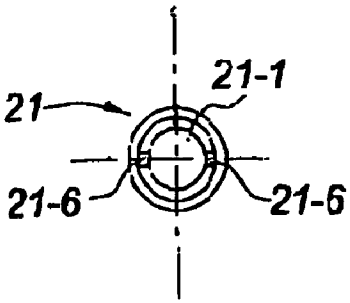
Figure 4A:
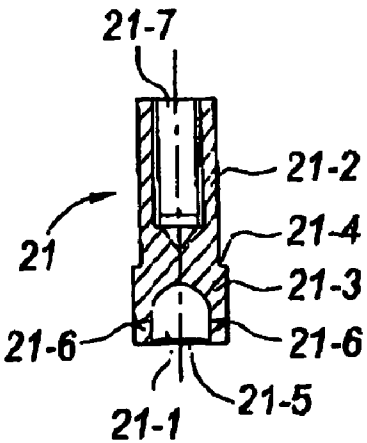

The present invention will be described hereinafter in a more detailed manner using the appended drawings in which:

FIG. 1A is a sectional view of a butt equipped with an insert having two spherical-based cavities according to the invention, FIG. 1B is a side view of the butt equipped with the insert, FIG. 2A is a section through a hand-rest equipped with an insert according to the invention, FIG. 2B is a side view of the hand-rest of FIG. 2A, FIG. 3A is a view of a stirrup showing the spherical end of two clamping screws, which stirrup is to receive a weapon provided with symmetrical spherical cavities, FIG. 3B shows the installation of an insert between the two symmetrical clamping screws, the installation of a weapon in the stirrup being shown schematically, FIG. 4A is a view in axial section of a female portion of an insert according to the invention, FIG. 4B is a front view of the insert portion of FIG. 4A, FIG. 5A is a partially sectioned view of the second portion or male portion of the insert according to the invention, FIG. 5B is a front view of the portion of the insert of FIG. 5A, FIG. 6 is a view of a clamping screw without its knurled wheel, FIG. 7 is a view of a clamping screw with a knurled nut wheel and a knurled counternut wheel for locking.

DESCRIPTION OF EMBODIMENTS OF THE INVENTION

According to the Figures, the invention relates to equipment for installing and testing a small-calibre weapon on a test bench. The test bench is not shown. It is composed of a base portion or mount which is secured to a natural support such as a tree trunk, a column or on the body of a firing cabin by means of straps or other removable securing means. This test bench, which is preferably transportable, comprises means enabling a weapon to be mounted (flanged) in order to carry out tests and then to be dismounted. These means, intended for a small-calibre weapon which is long or a hip weapon, are composed of two U-shaped stirrups constituting the vice, as it were, receiving the weapon on the mount. The stirrups are provided with clamping screws for bearing against the weapon and locking it in the stirrups. Finally the test bench comprises a shock absorber absorbing the recoil of the weapon at the moment of firing.

These various known parts of the test bench are not represented, only one stirrup is, knowing that the two stirrups are in principle of the same structure and symmetrical.

The invention relates to equipment for such a test bench. This equipment is composed of a set of spherical-based cavities provided in or on the weapon to be tested, and a set of clamping screws having a spherical head which are carried by the stirrups and are housed in the spherical-based cavities formed in or on the weapon to be tested.

FIG. 1A shows by way of example a gun butt 1 equipped with an insert 2. The insert is housed in a stepped drilled hole 3 formed in the butt 1 and directed perpendicularly to the plane of symmetry at the centre plane MM (FIG. 1A). In this example, the insert is a double insert and comprises two cavities 21-1, 22-1 having a spherical base which house the spherical heads of two clamping screws VP marked here by arrows directed along the axis XX of the insert. According to other examples, the insert is a simple member provided with a single spherical cavity. This insert may also be replaced by a cavity of corresponding shape machined in a metal portion of the weapon permitting such machining. Finally, the arrangement of the spherical cavities relative to the centre plane MM is advantageous but not strictly necessary.

The stepped drilled hole 3 is composed of a central portion 31 of small diameter bordered on each side by a portion 32, 33 of enlarged diameter, in the form of a spot face, opening out at the faces 11, 12 of the butt 1. The insert 2 is itself formed by two portions 21, 22, one female, the other male. The female portion is represented in FIGS. 4A, 4B; the male portion in FIGS. 5A, 5B.

According to the example of FIGS. 4A-5B, the first portion 21 of the insert 2 is a generally cylindrical member formed by a body 21-2 having a diameter corresponding to that of small diameter 31 and by a head 21-3 of enlarged diameter forming a shoulder 21-4 with the body 21-2. The head 21-3 has a diameter corresponding to that of the drilled hole 32 and the height of the head 21-3 corresponds to the depth of the drilled hole 32.

This portion 21 of the insert is placed in the drilled hole 3 as shown by FIG. 1A in such a manner that the outer face 21-5 of the portion 21 does not extend beyond the surface 12 of the butt.

The head 21-3 comprises a spherical housing 21-1, or more exactly a hemispherical housing, which is sunk into the head 21-3 beyond the diametral plane of this hemispherical shape and which is extended towards the front by a circular cylindrical portion. Finally, at the front, the head is provided with a double slot 21-6 for receiving a screwing tool.

The body 21-1 of the portion 21 is provided with an internal thread 21-7 in order to be assembled with the threaded portion of the second member 22.

This second member 22 (FIGS. 5A–5B) is composed of a cylindrical body 22-2 which has a diameter equal to that of the drilled hole 31 and which is extended towards the front by a threaded portion 22-7 having a diameter and a thread corresponding to the internal thread of the housing 21-7 of the first member 21.

At the other end, the body 22-2 is extended by a head 22-3 having an enlarged diameter and forming, as in the case of the portion 21, a shoulder 22-4. The head 22-3 has a diameter corresponding to that of the drilled hole 33 which is equal to that of the drilled hole 32.

The height of the head 22-3 is substantially equal to the depth of the drilled hole 33 so that its front face 22-5 does not extend beyond the lateral face 11 of the butt 1.

At the front face, the existing collar of the head 22-3, surrounding a spherical housing 22-1, is provided with a double diametral notch 22-6 enabling the portion 22 to be screwed to the portion 21.

The spherical housing 22-1 is in fact a hemispherical housing the diametral plane of which is set back relative to the front face 22-5 and which is extended as far as that face by a cylindrical portion having a circular cross-section. The assembly of the two portions 21, 22 is effected by screwing as shown in FIG. 1A.

However, it is also possible to form in the member 21, not an internal thread 21-7 but a simple non-threaded drilled hole and to extend the portion 22 by a non-threaded rod 22-7 having a diameter corresponding to that of the drilled hole 21-7.

In the case of that embodiment, the assembly of the two portions 21, 22 in the drilled hole of the butt 1 is effected by adhesively bonding the two members to one another.

FIG. 6 shows the form of a clamping screw 4 which is to clamp a weapon at the portions 21, 22 of the insert 2. The screw 4 is composed of a threaded rod 41 which is terminated at the front by a conical transition surface 42 provided with a spherical head 43 having a collar 44. At the other end the screw 4 is provided with an internal thread 45 for receiving the threaded end of a knurled wheel. The threaded portion 41 may also receive a counternut closed by a knurled wheel having notches.

Such clamping screws 4 are housed in the stirrup 6 as shown by FIG. 3A and project from the inside thereof in order to engage in the spherical cavity of an insert, such as the insert 2 represented in FIG. 3B. This insert 2 is incorporated in a portion of the weapon, such as, for example, the butt 1 of FIG. 1A or 1B. However, for ease of understanding, the weapon is not shown.

Clamping is effected by acting on the clamping screws 4. Transverse clamping of the weapon is effected in each stirrup by means of the spherical-headed screws 4 tightened in the spherical housings of the weapon. Clamping is completed by a screw 4A of the same type but the spherical head of which receives a block articulated to the head and bearing against the underside of the weapon. The block is not shown in FIGS. 3A, 3B. It is also possible to provide at the bearing site of the screw 4A a housing having a spherical cavity and in that case the screw will not comprise a bearing block.

The locking device permits excellent flanging with only three screws because, when the lower clamping screw of the "U" stirrup is under pressure, it compensates for the residual clearances on the two upper clamping screws.

A clamping screw 4 is represented by way of example in FIG. 7. This Figure shows the various parts already described by means of FIG. 6 with, in addition, the knurled wheel 46 and the counternut 47 having notches.

FIGS. 2A, 2B show the incorporation of an insert 2 in a hand-rest 5 of a gun. The hand-rest (not shown in detail) is provided with a stepped drilled hole like that formed in the butt 1 in order to receive the insert, which is either screwed in as shown in FIG. 2A or simply fitted and adhesively bonded.

It should also be noted that the screwed-in insert is preferably also adhesively bonded by an adhesive of the thread-lock type permitting nonpermanent mounting in order to prevent shocks and vibrations from unscrewing the two portions 21, 22 relative to one another; the insert may be welded or crimped.

The insert may also be a form machined in a metal portion of the weapon, with the exception of the barrel.

The inserts or the spherical cavities formed directly in the mass are preferably provided at two sites on the weapon, at the front and at the rear.

In the case of a weapon portion made of sheet-metal, the spherical cavity is produced by stamping.

By way of example, the orifice of the insert corresponds to a hole having a diameter of 8 millimetres and a depth of 7 millimetres. These cavities may, as indicated, either be machined directly in the weapon or be constituted by an insert 2. In the case of the insert, this member is produced from high-strength steel or from titanium. It is burnished or phosphated by surface treatment. The clamping screws are also produced from steel. They are also surface-treated by burnishing or phosphating.

What is claimed is:

1. Equipment for installing a small-calibre weapon on a test bench, comprising U-shaped stirrups provided with clamping screws for bearing against the weapon and locking it in the stirrups, characterised in that it comprises a set of cavities (21-1, 22-2) which have a spherical base and which are formed in the weapon at the bearing points of the clamping screws (4), and clamping screws (4) which have a spherical head (42) and which are carried by the stirrups (6) and housed in the spherical-based cavities (21-1, 22-1) of the weapon to be tested.

2. Equipment according to claim 1, characterised in that the cavity (21-1, 22-1) having a spherical base is formed in an insert (2) incorporated in the weapon.

3. Equipment according to claim 2, characterised in that the insert (2) comprises two cylindrical sleeves (21, 22) having a shoulder which are introduced into and assembled in a drilled hole (3) extending through the weapon and which each open out at a face of the weapon by way of a spherical cavity (21-1, 22-1).

4. Equipment according to claim 3, characterised in that the two sleeves (21, 22) are provided with complementary threads (21-7, 22-7) and are screwed one into the other.

5. Equipment according to claim 3, characterised in that the two sleeves (21, 22) are provided, one with a cylindrical housing, the other with a cylindrical spindle which are to engage one in the other when the two sleeves are assembled in an orifice formed in the weapon, and these two sleeves are assembled by adhesive bonding.

6. Equipment according to claim 1, characterised in that the cavity having a spherical base is machined in the weapon.

* * * * *